US008449062B2

(12) United States Patent
Kaneko et al.

(10) Patent No.: US 8,449,062 B2
(45) Date of Patent: May 28, 2013

(54) IMAGE FORMING APPARATUS RESPONDING TO REQUEST DURING USE OF ERASABLE INK

(75) Inventors: Yoshiaki Kaneko, Shizuoka (JP); Minoru Yoshida, Tokyo (JP); Takeshi Watanabe, Kanagawa (JP); Takashi Kado, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 318 days.

(21) Appl. No.: 12/766,470

(22) Filed: Apr. 23, 2010

(65) Prior Publication Data

US 2010/0271410 A1 Oct. 28, 2010

Related U.S. Application Data

(60) Provisional application No. 61/173,099, filed on Apr. 27, 2009.

(51) Int. Cl.
*B41J 29/38* (2006.01)

(52) U.S. Cl.
USPC ..... 347/14; 347/6

(58) Field of Classification Search
None
See application file for complete search history.

(56) References Cited

U.S. PATENT DOCUMENTS

| | | | | |
|---|---|---|---|---|
| 5,394,231 | A | 2/1995 | Sudo et al. | |
| 5,574,538 | A * | 11/1996 | Takahashi et al. | 399/71 |
| 5,922,115 | A | 7/1999 | Sano et al. | |
| 6,375,293 | B1 * | 4/2002 | Endo | 347/2 |

FOREIGN PATENT DOCUMENTS

| | | |
|---|---|---|
| JP | 06-095494 | 4/1994 |

* cited by examiner

*Primary Examiner* — Geoffrey Mruk
(74) *Attorney, Agent, or Firm* — Patterson & Sheridan, LLP

(57) ABSTRACT

An image forming apparatus includes: a first image forming unit configured to form an image with erasable first ink; a second image forming unit configured to share a conveying path with the first image forming unit and form an image with not erasable second ink; a recording unit configured to record a level of use of a recording medium on the recording medium; a detecting unit configured to detect the level of use; and a control unit configured to control the first image forming unit or the second image forming unit according to a detection result of the detecting unit.

15 Claims, 4 Drawing Sheets

| CUMULATIVE PRINTING RATIO (%) | PRINTING SPEED (mm/sec) | DRIVING FREQUENCY OF INK-JET HEAD (kHz) | NUMBER OF TIMES OF PRINT PASS (TIMES) | DRYING TEMPERATURE OF DRYING UNIT (°C) WHEN ERASING TEMPERATURE IS SET TO 80 °C |
|---|---|---|---|---|
| 0 TO LOWER THAN 5% (STANDARD PROCESS VALUE) | 812 | 19.2 | 1 | 50 |
| 5 TO LOWER THAN 20% | 406 | 9.6 | 1 | 55 |
| 20 TO LOWER THAN 50% | 203 | 4.8 | 1 | 60 |
| 50 TO LOWER THAN 100% | 102 | 4.8 | 2 | 60 |
| 100 TO LOWER THAN 150% | 51 | 4.8 | 4 | 60 |
| EQUAL TO OR HIGHER THAN 150% | DISCARD SHEET | | | |

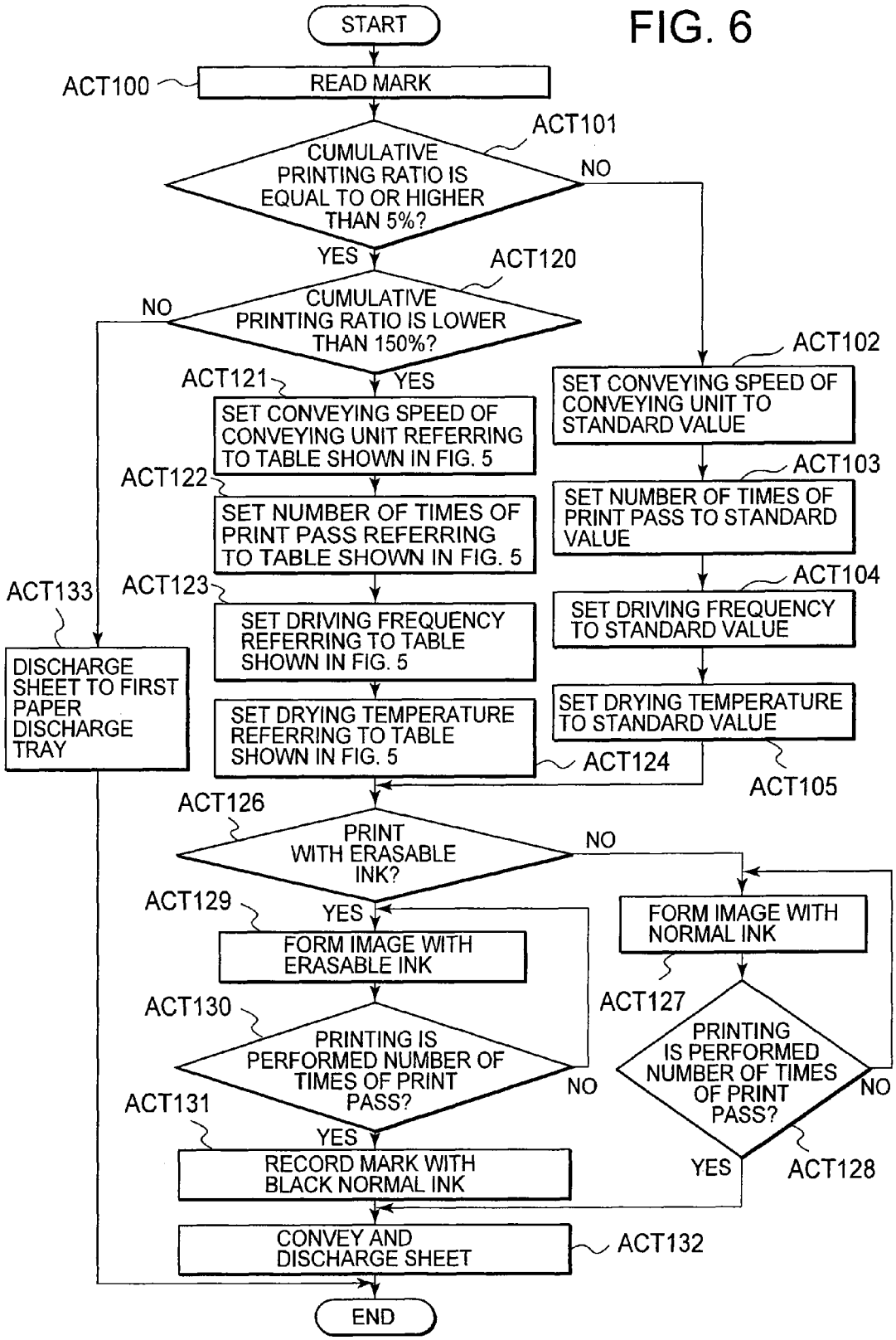
FIG. 6
START
ACT100
READ MARK
ACT101
CUMULATIVE PRINTING RATIO IS EQUAL TO OR HIGHER THAN 5%?
NO
YES
ACT120
CUMULATIVE PRINTING RATIO IS LOWER THAN 150%?
NO
YES
ACT121
SET CONVEYING SPEED OF CONVEYING UNIT REFERRING TO TABLE SHOWN IN FIG. 5
ACT122
SET NUMBER OF TIMES OF PRINT PASS REFERRING TO TABLE SHOWN IN FIG. 5
ACT123
SET DRIVING FREQUENCY REFERRING TO TABLE SHOWN IN FIG. 5
SET DRYING TEMPERATURE REFERRING TO TABLE SHOWN IN FIG. 5
ACT124
ACT133
DISCHARGE SHEET TO FIRST PAPER DISCHARGE TRAY
ACT102
SET CONVEYING SPEED OF CONVEYING UNIT TO STANDARD VALUE
ACT103
SET NUMBER OF TIMES OF PRINT PASS TO STANDARD VALUE
ACT104
SET DRIVING FREQUENCY TO STANDARD VALUE
SET DRYING TEMPERATURE TO STANDARD VALUE
ACT105
ACT126
PRINT WITH ERASABLE INK?
NO
YES
ACT129
FORM IMAGE WITH ERASABLE INK
ACT130
PRINTING IS PERFORMED NUMBER OF TIMES OF PRINT PASS?
NO
YES
ACT131
RECORD MARK WITH BLACK NORMAL INK
FORM IMAGE WITH NORMAL INK
ACT127
PRINTING IS PERFORMED NUMBER OF TIMES OF PRINT PASS?
NO
YES
ACT128
CONVEY AND DISCHARGE SHEET
ACT132
END

IMAGE FORMING APPARATUS RESPONDING TO REQUEST DURING USE OF ERASABLE INK

CROSS-REFERENCE TO RELATED APPLICATION

This application is based upon and claims the benefit of priority from Provisional U.S. Application 61/173099 filed on Apr. 27, 2009, the entire contents of which are incorporated herein by reference.

TECHNICAL FIELD

The present invention relates to an image forming apparatus including an image forming unit configured to form an image with erasable ink and an image forming unit configured to form an image with not erasable ink.

BACKGROUND

In recent years, as an image forming apparatus configured to form an image on a recording medium, there is an apparatus configured to erase an image on a sheet and reuse the sheet. The reuse of the sheet saves paper resources and realizes environmental protection. Further, as the image forming apparatus, there is an apparatus configured to perform, in order to realize low cost and space saving, a process for forming an image with an erasable toner and a process for forming an image with a normal toner. For example, JP-A-06-95494 discloses an apparatus configured to select the normal toner or the erasable toner and perform an image forming process.

However, even if the image on the sheet is erased, ingredients of the erasable ink or toner remain on the sheet. Therefore, when the image formation and the image erasing on the sheet are repeated, an area where the ingredients of the erased sheet or toner remain on the sheet expands. In the area where the ingredients of the ink or toner remain, it is likely that the ink less easily penetrates the sheet during the next image formation and image quality is deteriorated. For example, when the image on the sheet is erased by heat, it is likely that, while the image formation and image erasing on the sheet are repeated, characteristics of the sheet are changed by the influence of the heat and image quality is deteriorated.

Therefore, there is a demand for development of an image forming apparatus configured to grasp a state of a sheet and control an image forming process according to the state of the sheet.

SUMMARY

According to an aspect of the invention, a satisfactory image quality is obtained irrespectively of a level of use of a sheet.

According to an embodiment, an image forming apparatus including: a first image forming unit configured to form an image with erasable first ink; a second image forming unit configured to share a conveying path with the first image forming unit and form an image with not erasable second ink; a recording unit configured to record a level of use of a recording medium on the recording medium; a detecting unit configured to detect the level of use; and a control unit configured to control the first image forming unit or the second image forming unit according to a detection result of the detecting unit.

DESCRIPTION OF THE DRAWINGS

FIG. 6 is a flowchart for explaining print operation in the first embodiment.

DETAILED DESCRIPTION

Figure 1:
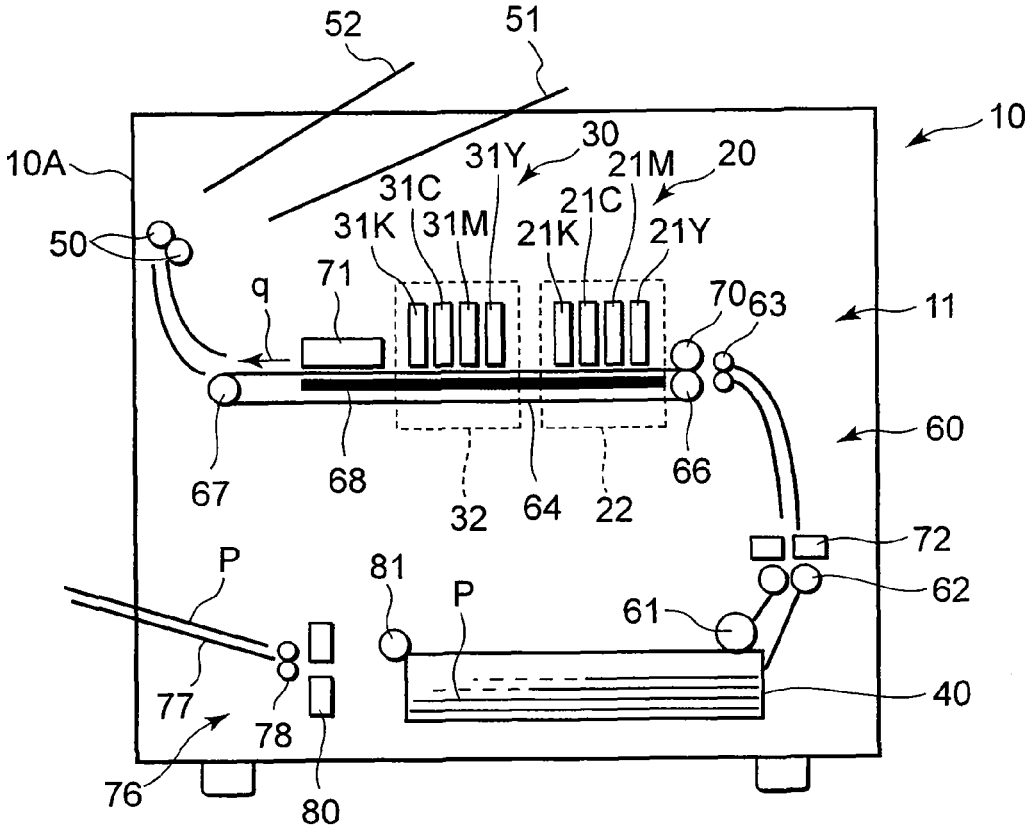
FIG. 1 is a schematic diagram of an image forming apparatus according to a first embodiment.

Embodiments are explained below. FIG. 1 is a schematic diagram of a hybrid printer 10 as an image forming apparatus according to a first embodiment. A printer unit 11 of the hybrid printer 10 includes a first ink-jet head unit 20 as a first image forming unit and a second ink-jet head unit 30 as a second image forming unit that also functions as a recording unit. The first ink-jet head unit 20 is a color printer of an ink-jet system. The first ink-jet head unit 20 forms an image using erasable ink as first ink that is erased when heated to temperature equal to or higher than erasing temperature. The second ink-jet head unit 30 is a color printer of the ink-jet system. The second ink-jet head unit 30 forms an image using normal ink as not erasable second ink.

The hybrid printer 10 includes a cassette 40 configured to store sheets P as recording medium. The hybrid printer 10 includes a first paper discharge tray 51 and a second paper discharge tray 52 to which the sheet P passed through the first ink-jet head unit 20 and the second ink-jet head unit 30 is discharged. The first ink-jet head unit 20 and the second ink-jet head unit 30 share a conveying unit 60 extending from the cassette 40 to the first paper discharge tray 51 or the second paper discharge tray 52 through the first ink-jet head unit 20 and the second ink-jet head unit 30. The conveying unit 60 includes a pickup roller 61 configured to extract the sheet P from the cassette 40, a conveying roller pair 62, a registration roller pair 63, a conveyor belt 64, and a paper discharge roller pair 50.

A driving roller 66 and a driven roller 67 rotate the conveyor belt 64 in an arrow q direction. The conveyor belt 64 has holes on the surface thereof at predetermined intervals. The conveyor belt 64 holds a negative pressure chamber 68 on the inner side thereof. The negative pressure chamber 68 attracts the sheet P to the conveyor belt 64 via the holes of the conveyor belt 64. A pressing roller 70 presses the sheet P, which is conveyed to the conveyor belt 64, against the conveyor belt 64. The pressing roller 70 prevents the sheet P from rising on the conveyor belt 64. A drying unit 71 is opposed to the conveyor belt 64 and dries ink on the sheet P conveyed by the conveyor belt 64.

The first ink-jet head unit 20 includes ink-jet heads 21Y, 21M, 21C, and 21K for Y (yellow), M (magenta), C (cyan), and K (Black) arranged in parallel to one another along the conveyor belt 64. The ink-jet heads 21Y, 21M, 21C, and 21K respectively eject erasable inks of colors Y (yellow), M (magenta), C (cyan), and K (black) that are erased when heated to temperature equal to or higher than erasing temperature of, for example, 80° C.

In the ink-jet head 21Y for yellow (Y), plural nozzles are arrayed at predetermined intervals over, for example, width of 297 mm that is maximum recording width of the sheet. P. The ink-jet heads 21M, 21C, and 21K for magenta (M), cyan (C), and black (K) have structure same as that of the ink-jet head 21Y for yellow (Y). The ink-jet heads 21Y, 21M, 21C, and 21K print ink images corresponding to image information to be superimposed one on top of another on the sheet P traveling in the arrow q direction.

Erasable ink that is erased when heated to the temperature equal to or higher than the erasing temperature is disclosed in, for example, JP-A-2007-212613 and JP-A-2007-90704. The erasable ink contains, for example, a color-assuming compound such as leuco dye, a developer, and binder resin having an erasing action and the like. When the erasable ink is heated to temperature lower than the erasing temperature, since the color-assuming compound is subjected to the action of the developer and develops a color, the color of the erasable ink can be recognized. When the erasable ink is heated to temperature equal to or higher than the erasing temperature, the developer in the binder resin moves to the surface thereof according to softening of the binder resin and spreads over the sheet P. The color-assuming compound stops being subjected to the action of the developer and is erased. Therefore, the color of the erasable ink cannot be recognized. The erasing temperature for the erasable ink is adjusted by the material design of the color-assuming compound, the developer, the binder resin, and the like.

As the color-assuming compound, it is desirable to use, for example, an electron-donating organic matter such as leuco-auramines, diarylphthalides, polyarylcarbinols, acylauramines, arylauramines, rhodamine B, lactams, indolines, spiropyrans, or fluorans.

As the developer, it is desirable to use, for example, phenols, phenolic metal salts, carboxylic metal salts, benzophenones, sulfonic acid, sulfonic salts, phosphoric acids, phosphoric metal salts, acid phosphoric ester, acid phosphoric ester metal salts, phosphorous acids, or phosphorous acid metal salts.

The ink-jet heads 21Y, 21M, 21C, and 21K configure an integral cartridge 22 and are integrally detachably attachable to amain body 10A of the hybrid printer 10 and replaceable. The ink-jet heads 21Y, 21M, 21C, and 21K formed as a unit can be set in the main body 10A as an option according to a demand of a user.

The second ink-jet head unit 30 includes ink-jet heads 31Y, 31M, 31C, and 31K for Y (yellow), M (magenta), C (cyan), and K (black) arranged in parallel to one another along the conveyor belt 64. The ink-jet heads 31Y, 31M, 31C, and 31K respectively eject un-erasable normal inks of colors Y (yellow), M (magenta), C (cyan), and K (black). The ink-jet heads 31Y, 31M, 31C, and 31K have structure same as that of the ink-jet head 21Y for yellow (Y).

The ink-jet heads 31Y, 31M, 31C, and 31K print ink images corresponding to image information to be superimposed one on top of another on the sheet P traveling in the arrow q direction. For example, the ink-jet head 31K for K (black) functions as a recording unit. The ink-jet head 31K for K (black) records a mark indicating a level of use of the sheet P in a part of the sheet P. The ink-jet heads 31Y, 31M, 31C, and 31K configure an integral cartridge 32 and are integrally detachably attachable to the main body 10A and replaceable.

The mark indicating a level of use of the sheet P indicates a state of deterioration of the sheet P during reuse. The ink-jet head 31K records, for example, a mark indicating a printing ratio at the time of image forming, by the first ink-jet head unit 20 on the sheet P. The ink-jet head 31K additionally writes a printing ratio during image formation on the sheet P every time an image forming process is repeated on the sheet P.

Example 1

Figure 2:
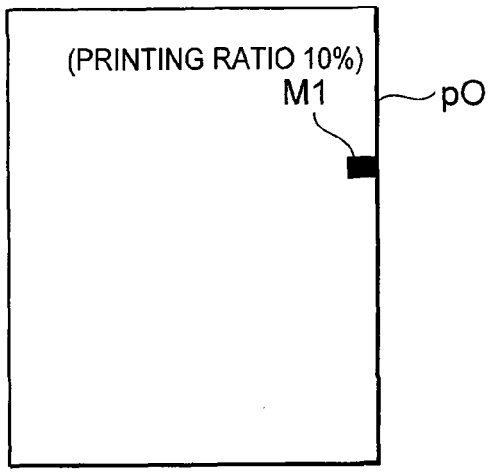
FIG. 2 is a schematic explanatory diagram of a sheet having a mark indicating a printing ratio in the first embodiment.

(1) When an image with a printing ratio of 10% is formed on an unused sheet p0 with erasable ink, the ink-jet head 31K records a mark M1 as a digital code shown in FIG. 2 on the sheet p0. The mark M1 represents the printing ratio of 10%.

(2) Thereafter, when the image on the sheet p0 is erased, only the mark M1 remains on the sheet p0.

Figure 3:
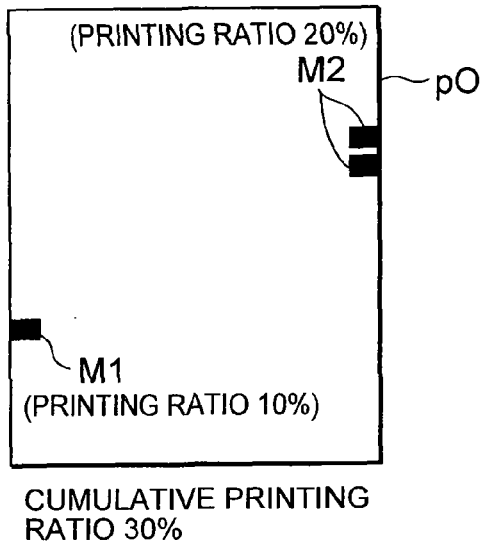
FIG. 3 is a schematic explanatory diagram of a sheet having a new mark indicating a printing ratio in addition to the mark shown in FIG. 2 in the first embodiment.

(3) In the following reuse of the sheet p0, when an image with a printing ratio of 20% is formed on the sheet p0, on which the mark M1 is recorded, with the erasable ink, the ink-jet head 31K records a mark M2 shown in FIG. 3 on the sheet p0. The mark M2 represents the printing ratio of 20%.

(4) Thereafter, when the image on the sheet p0 is erased, the mark M1 and the mark M2 remain on the sheet p0. The mark M1 and the mark M2 indicate that a cumulative printing ratio in the past of the sheet p0 is 30%.

(5) Similarly, every time reuse of the sheet p0 is repeated, the ink-jet head 31K additionally writes a mark Mn corresponding to a printing ratio during the reuse on the sheet p0.

The cumulative printing ratio is an indicator of a state of use or a state of deterioration of the sheet p0. For example, when the cumulative printing ratio is equal to or higher than 150%, this indicates a state in which a desired print image cannot be obtained on the sheet p0 because of deterioration of the sheet p0.

The mark Mn indicating a printing ratio can be recorded as a circle or square sign, a digital code such as a barcode or a QR code, or an analog code such as alphanumeric, kana, or Greek characters. Further, the mark Mn indicating a printing ratio can also be recorded by punching pinholes or the like.

The hybrid printer 10 includes, for example, a mark sensor 72 as a detecting unit in the conveying unit 60. The mark sensor 72 reads a mark recorded on the reuse sheet P using a photosensor. The mark sensor 72 reads both sides of the sheet P to read the mark irrespectively of a conveying direction of the reuse sheet P. A detection result obtained by reading the mark with the mark sensor 72 is fed back to control of a print process of the hybrid printer 10.

The hybrid printer 10 includes an erasing unit 76 as an erasing device in a lower part thereof. The erasing unit 76 heats an ink image formed on the sheet P with the erasable ink to temperature equal to or higher than the erasing temperature and erases the ink image. The erasing unit 76 includes a paper feeding tray 77, a conveying roller pair 78 configured to convey the sheet P on the paper feeding tray 77, and a heater 80 configured to heat the sheet P. The conveying roller pair 78 and a transmitting roller 81 store the sheet P passing through the heater 80 in the cassette 40. The cassette 40 stores the unused or reuse sheet P at random. As the erasing device, a heater of a heat roller type may be used. The erasing device may be externally attached to the hybrid printer 10.

Figures 4, 5:
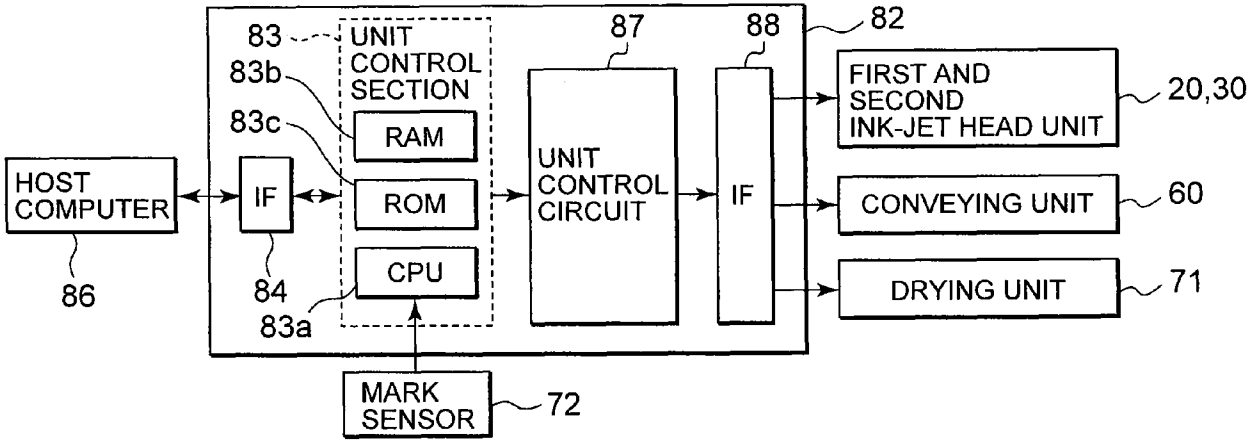
FIG. 4 is a block diagram of a control system in the first embodiment.
FIG. 5 is a table of process values corresponding to levels of use of a sheet in the first embodiment.

FIG. 4 is a block diagram of a control system 82 as a control unit configured to mainly perform process control for the printer unit 11 based on a reading result of the mark sensor 72. The control system 82 includes a unit control section 83 and a unit control circuit 87. The control system 82 connects, via an interface 84, a host computer 86 configured to control the entire hybrid printer 10 and the unit control section 83. The control system 82 connects, via an interface 88, the unit control circuit 87 to the first and second ink-jet head units 20 and 30, the conveying unit 60, and the drying unit 71.

The unit control section 83 includes a CPU 83*a*, a random access memory (RAM) 83*b*, and a read only memory (ROM)

83*c*. The CPU 83*a* controls the unit control circuit 87 according to a detection result of the mark sensor 72 to adjust processes of the ink-jet head units 20 and 30, the conveying unit 60, and the drying unit 71. The ROM 83*c* stores, for example, as shown in FIG. 5, a table of process values of the ink-jet head units 20 and 30, the conveying unit 60, and the drying unit 71 corresponding to a level of use of the reuse sheet P.

For example, when a cumulative printing ratio recorded on the sheet P is 0% to lower than 5%, the CPU 83*a* sets the process values to standard process values, i.e., 812 (mm/sec) as printing speed (speed of the sheet P passing through the paper discharge roller pair 50), 19.2 (kHz) as a driving frequency of any one of the first and second ink-jet heads 20 and 30 or both, once as the number of times of print pass that is the number of times printing is carried out by any one of the first and second ink-jet heads 20 and 30 or both in order to form one image, and 50° C. as drying temperature of the drying unit 71.

When the cumulative printing ratio recorded on the sheet P is 5% to lower than 20%, the CPU 83*a* sets the process values to 406 (mm/sec) as printing speed (speed of the sheet P passing through the paper discharge roller pair 50), 9.6 (kHz) as a driving frequency of any one of the first and second ink-jet heads 20 and 30 or both, once as the number of times of print pass, and 55° C. as drying temperature of the drying unit 71.

When the cumulative printing ratio recorded on the sheet P is 20% to lower than 50%, the CPU 83*a* sets the process values to 203 (mm/sec) as printing speed (speed of the sheet P passing through the paper discharge roller pair 50), 4.8 (kHz) as a driving frequency of any one of the first and second ink-jet heads 20 and 30 or both, once as the number of times of print pass, and 60° C. as drying temperature of the drying unit 71.

When the cumulative printing ratio recorded on the sheet P is 50% to lower than 100%, the CPU 83*a* sets the process values to 102 (mm/sec) as printing speed, 4.8 (kHz) as a driving frequency of any one of the first and second ink-jet heads 20 and 30 or both, twice as the number of times of print pass, and 60° C. as drying temperature of the drying unit 71.

When the cumulative printing ratio recorded on the sheet P is 100% to lower than 150%, the CPU 83*a* sets the process values to 51 (mm/sec) as printing speed (speed of the sheet P passing through the paper discharge roller pair 50), 4.8 (kHz) as a driving frequency of any one of the first and second ink-jet heads 20 and 30 or both, four times as the number of times of print pass, and 60° C. as drying temperature of the drying unit 71.

When the cumulative printing ratio recorded on the sheet P is equal to or higher than 150%, the CPU 83*a* determines that the sheet P is unsuitable for reuse and sets discard processing.

The CPU 83*a* determines a cumulative printing ratio of the sheet P from a detection result of the mark sensor 72. The CPU 83*a* sets, referring to the table shown in FIG. 5, the unit control circuit 87 to perform control with process values corresponding to the cumulative printing ratio.

Print operation is explained below with reference to a flowchart shown in FIG. 6. The cassette 40 stores the unused or reuse sheets P at random. According to print start, the conveying unit 60 extracts the sheet P from the cassette 40 and conveys the sheet P in the direction of the registration roller pair 63. The mark sensor 72 reads the mark Mn on the sheet P traveling from the conveying roller pair 62 in the direction of the registration roller pair 63 (ACT 100). When a cumulative printing ratio is lower than 5% judging from a result of the reading (No in Act 101), the CPU 83*a* proceeds to ACT 102.

When the cumulative printing ratio is lower than 5% (No in ACT 101), the CPU 83*a* determines that the sheet P is unused or the cumulative printing ratio of the sheet P is lower than 5%. The CPU 83*a* sets the conveying speed of the conveying unit 60 to the standard process value such that the speed of the sheet P passing through the paper discharge roller pair 50 reaches printing speed (ACT 102). The CPU 83*a* sets the number of times of print pass to the standard process value (ACT 103). The CPU 83*a* sets the driving frequency of the first and second ink-jet head units 20 and 30 to the standard process value (ACT 104). The CPU 83*a* sets the drying temperature of the drying unit 71 to the standard process value (ACT 105) and proceeds to ACT 126.

When the cumulative printing ratio recorded on the sheet P is equal to or higher than 5% judging from the mark Mn read in ACT 100 (Yes in ACT 101), the CPU 83*a* proceeds to ACT 120. When the cumulative printing ratio recorded on the sheet P is lower than 150% (Yes in ACT 120), the CPU 83*a* proceeds to ACT 121.

In ACT 121 to ACT 124, the CPU 83*a* sets, referring to the table shown in FIG. 5, the respective process values according to the cumulative printing ratio. In ACT 121, the CPU 83*a* sets the conveying speed of the conveying unit 60 such that the speed of the sheet P passing through the paper discharge roller pair 50 reaches the printing speed. In ACT 122, the CPU 83*a* sets the number of times of print pass. In ACT 123, the CPU 83*a* sets the driving frequency of the first and second ink jet head units 20 and 30. In ACT 124, the CPU 83*a* sets the drying temperature of the drying unit 71 and proceeds to ACT 126.

When the cumulative printing ratio recorded on the sheet P is equal to or higher than 150% in ACT 120, the CPU 83*a* proceeds to ACT 133 without applying the print operation to the reuse sheet P. In order to subject the reuse sheet P to discard processing, the CPU 83*a* causes the conveying unit 60 to convey and discharge the sheet P to the first paper discharge tray 51 and ends the print operation.

In ACT 126, the CPU 83*a* determines whether the sheet P is printed with the erasable ink. When the sheet P is printed with the normal ink (No in ACT 126), the CPU 83*a* proceeds to ACT 127. In ACT 127, the CPU 83*a* causes the second ink-jet head unit 30 to form an image by the normal ink on the sheet P at the process values corresponding to the cumulative printing ratio of the sheet P. In ACT 127, in order to cause the second ink-jet head unit 30 to form an image, the CPU 83*a* causes the pressing roller 70 to press the sheet P against the conveyor belt 64 and causes the negative pressure chamber 68 to attract the sheet P to the conveyor belt 64 to convey the sheet P in the arrow q direction. The ink-jet heads 31Y, 31M, 31C, and 31K print, according to image information, ink images to be superimposed one on top of another on the sheet P traveling in the arrow q direction and form a color image by the normal ink on the sheet P.

When the number of times of print pass set in ACT 122 is plural times and the CPU 83*a* determines in ACT 128 that printing is not performed the number of times of pass set in ACT 122 (No in ACT 128), the CPU 83*a* returns to ACT 127 and causes the second ink-jet head unit 30 to repeatedly form images by the normal ink on the sheet P attracted to the conveyor belt 64 and circulated. In ACT 127, every time an image is formed with the normal ink, the drying unit 71 dries the image formed by the normal ink on the sheet P at the drying temperature set according to the cumulative printing ratio recorded on the sheet P. When the CPU 83*a* determines in ACT 128 that printing is performed the number of times of print pass set in ACT 122 (Yes in ACT 128), the CPU 83*a* proceeds to ACT 132.

When the CPU 83*a* determines that the sheet P is printed with the erasable ink (Yes in ACT 126), the CPU 83*a* proceeds to ACT 129. In ACT 129, the CPU 83*a* causes the first ink-jet head unit 20 to form an image by the erasable ink on the sheet P at the process values corresponding to the cumulative printing ratio of the sheet P. In ACT 129, in order to cause the first ink-jet head unit 20 to form an image, the CPU 83*a* causes the pressing roller 70 to press the sheet P against the conveyor belt 64 and causes the negative pressure chamber 68 to attract the sheet P to the conveyor belt 64 to convey the sheet P in the arrow q direction. The ink-jet heads 21Y, 21M, 21C, and 21K print, according to image information, ink images to be superimposed one on top of another on the sheet P traveling in the arrow q direction and form a color image by the erasable ink on the sheet P.

When the number of times of print pass set in ACT 122 is plural times and the CPU 83*a* determines in ACT 130 that printing is not performed the number of times of pass set in ACT 122 (No in ACT 130), the CPU 83*a* returns to ACT 129 and causes the first ink-jet head unit 20 to repeatedly form images by the erasable ink on the sheet P attracted to the conveyor belt 64 and circulated. In ACT 129, every time an image is formed with the erasable ink, the drying unit 71 dries the image formed with the normal ink on the sheet P at the drying temperature set according to the cumulative printing ratio recorded on the sheet P. When the CPU 83*a* determines in ACT 130 that printing is performed the number of times of print pass set in ACT 122 (Yes in ACT 130), the CPU 83*a* proceeds to ACT 131.

In ACT 131, after causing the first head unit 20 to form an image on the sheet P with the erasable ink and further causing the ink-jet head 31K for K (black) to record the mark Mn indicating the printing ratio for the image formation in ACT 129 in a part of the sheet P traveling in the arrow q direction, the CPU 83*a* causes the drying unit 71 to dry the image and proceeds to ACT 132.

In ACT 132, the CPU 32*a* causes the conveying unit 60 to convey and discharge the sheet P having the image formed by using the normal ink or the erasable ink to the second paper discharge tray 52 and ends the print operation. In ACT 129, the CPU 83*a* causes the first ink-jet head unit 20 to form an image using the erasable ink. The mark Mn indicating the printing ratio is additionally written anew on the sheet P discharged to the second paper discharge tray 52.

The hybrid printer 10 performs printing. On the other hand, the erasing unit 76 erases the image formed on the sheet P in order to reuse the sheet P. The heater 80 of the erasing unit 76 heats the sheet P conveyed by the conveying roller pair 78 to temperature equal to or higher than 80° C. and erases the formed image. The transmitting roller 81 accumulates the sheet P in the cassette 40. The hybrid printer 10 forms an image on the reuse sheet P accumulated in the cassette 40.

According to the first embodiment, at the time of image forming, a cumulative printing ratio recorded on the sheet P is read from the mark Mn on the sheet P. Process values of the hybrid printer 10 are controlled according to the cumulative printing ratio to perform printing. Therefore, it is possible to obtain a print at more suitable process values and suppress deterioration in image quality irrespectively of a state of deterioration of the reuse sheet P.

A second embodiment is explained below. In the second embodiment, the cumulative printing ratio in the first embodiment is recorded more in detail. In the second embodiment, components same as those explained in the first embodiment are denoted by the same reference numerals and signs and detailed explanation of the components is omitted.

Example 2

Figure 7:
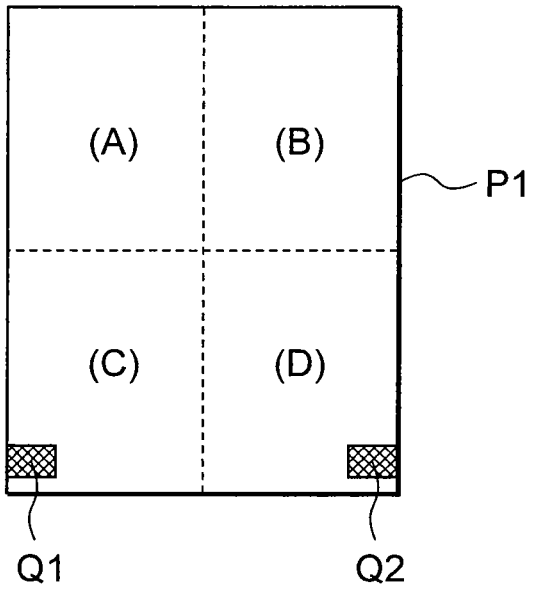
FIG. 7 is a schematic explanatory diagram of a sheet having marks indicating a printing ratio in a second embodiment.

(1) As shown in FIG. 7, a sheet P1 is divided into, for example, four areas (A), (B), (C), and (D).

(2) Every time reuse of the sheet P1 is repeated, a printing ratio of each of the areas (A), (B), (C), and (D) is recorded by using QR codes Q1 to Qn.

During printing, the hybrid printer 10 performs the printing at process values corresponding to a cumulative printing ratio of each of the areas of the sheet P1. When the cumulative printing ratio of the area (B) is equal to or higher than 150%, even if the cumulative printing ratios of the other areas (A), (C), and (D) are lower than 150%, the hybrid printer 10 determines that the sheet P1 is unsuitable for reuse and discards the sheet P1.

According to the second embodiment, when the sheet 91 is reused, process values of the hybrid printer 10 are controlled for each of the areas of the sheet 21 according to a cumulative printing ratio of each of the areas of the sheet P1 to perform printing. Even when the sheet P is locally deteriorated, it is possible to obtain a print at more suitable process values and suppress deterioration in image quality.

A third embodiment is explained below. In the third embodiment, components same as those explained in the first embodiment are denoted by the same reference numerals and signs and detailed explanation of the components is omitted. In the third embodiment, instead of a printing ratio of a sheet in the first embodiment, the number of times of use of a sheet (the number of times of erasing) is recorded as a mark indicating a level of use of a reuse sheet. Since the quality of a sheet is deteriorated every time the sheet is heated by the heater 80 to erase an image, the hybrid printer 10 stores a table of process values corresponding to the number of times of use of the sheet (the number of times of erasing) in the ROM 83*c*.

At the time of image forming, the hybrid printer 10 reads the number of times of use of a sheet (the number of times of erasing) and performs printing at process values corresponding to the number of times of use (the number of times of erasing). For example, when the number of times of use (the number of times of erasing) is equal to or larger than five times, the hybrid printer 10 determines that the sheet P1 is unsuitable for reuse and discards the sheet P1.

According to the third embodiment, process values of the hybrid printer 10 are controlled according to the number of times of use of the sheet P (the number of times of erasing). Therefore, it is possible to obtain printing at more suitable process values and suppress deterioration in image quality irrespectively of a state of deterioration of the sheet P.

The present invention is not limited to the embodiments and can be variously changed within the scope of the present invention. For example, the first ink may be an ink that is erased when light having predetermined wavelength is irradiated thereon. When the first ink is an ink that is erased by heat, erasing temperature is not limited. Further, process values of the first image forming unit and the second image forming unit controlled by the control unit are not limited and may be arbitrary process values such as printing speed. Wind speed or the like during drying may be adjusted and controlled.

What is claimed is:

1. An image forming apparatus comprising:

a first image forming unit configured to form an image with an erasable first ink;

a second image forming unit configured to share a conveying path with the first image forming unit and form an image with a non-erasable second ink;

a recording unit configured to record a level of use of a recording medium on the recording medium;

a detecting unit configured to detect the level of use; and a control unit configured to change an image formation process value based on the detected level of use and to control the first image forming unit or the second image forming unit based on the image formation process value.

2. The apparatus of claim 1, wherein the first ink is thermally erasable ink.

3. The apparatus of claim 1, wherein the detecting unit is provided on the conveying path before reaching the first image forming unit and the second image forming unit.

4. The apparatus of claim 1, wherein the recording unit sequentially calculates and records the level of use every time the recording medium is reused.

5. The apparatus of claim 1, wherein the recording unit records, as the level of use, a mark for determining an accumulated printing ratio on the recording medium by the second ink.

6. The apparatus of claim 5, wherein the accumulated printing ratio is one of accumulated printing ratios, each corresponding to one of plural areas on the recording medium.

7. The apparatus of claim 1, wherein the recording unit records, as the level of use, a number of times of image formation on the recording medium by the first ink.

8. The apparatus of claim 1, wherein the recording unit records the level of use as an analog code.

9. The apparatus of claim 1, wherein the recording unit records the level of use as a digital code.

10. The apparatus of claim 1, wherein the second image forming unit also functions as the recording unit and records the level of use with the second ink.

11. The apparatus of claim 1, wherein the recording unit punches holes in the recording medium to record the level of use.

12. The apparatus of claim 1, wherein the image formation process value is an image forming speed.

13. The apparatus of claim 1, wherein the image formation process value is a number of times of print pass.

14. The apparatus of claim 1, wherein the image formation process value is a drying temperature value for an image formed with the first ink or the second ink.

15. The apparatus of claim 1, wherein the control unit performs control to discard the recording medium if the detected level of use of the recording medium is equal to or above a discard level.

* * * * *